US012366234B2

(12) United States Patent
Povilonis et al.

(10) Patent No.: US 12,366,234 B2
(45) Date of Patent: Jul. 22, 2025

(54) PUMP HAVING A FLANGE FOR MOUNTING AN AUXILIARY PUMP

(71) Applicant: CATERPILLAR INC., Peoria, IL (US)

(72) Inventors: Romas J. Povilonis, Naperville, IL (US); David A. Mork, Yorkville, IL (US)

(73) Assignee: CATERPILLAR INC., Peoria, IL (US)

( * ) Notice: Subject to any disclaimer, the term of this patent is extended or adjusted under 35 U.S.C. 154(b) by 0 days.

(21) Appl. No.: 17/736,247

(22) Filed: May 4, 2022

(65) Prior Publication Data

US 2023/0358220 A1 Nov. 9, 2023

(51) Int. Cl.
*F04B 23/04* (2006.01)
*F04B 17/05* (2006.01)
*F04B 53/22* (2006.01)

(52) U.S. Cl.
CPC ..... *F04B 23/04* (2013.01); *F04B 17/05* (2013.01); *F04B 53/22* (2013.01)

(58) Field of Classification Search
CPC .... F04B 17/05; F04B 17/06; F04B 23/04–14; F04B 53/22; F04B 53/16
USPC ..... 417/364
See application file for complete search history.

(56) References Cited

U.S. PATENT DOCUMENTS 5,957,666 A * 9/1999 Lee ..... F04B 23/106 417/269
6,022,198 A * 2/2000 Hoffmeister ..... F04B 23/106 417/370
6,146,111 A 11/2000 Coleman
6,299,078 B1 * 10/2001 Fugere ..... B05C 17/00593 239/596
7,056,101 B1 * 6/2006 Hauser ..... F04B 1/22 60/485
7,257,948 B1 * 8/2007 Bennett ..... F04B 23/06 60/486

(Continued)

FOREIGN PATENT DOCUMENTS

CN 211039264 U 7/2020
DE 19828180 A1 * 1/2000 ..... F04B 1/2064

(Continued)

OTHER PUBLICATIONS

PCS Company, "Threaded Locating Pin Accessory", Oct. 28, 2020, p. 1 (Year: 2020) https://web.archive.org/web/20201028163617/https://www.pcs-company.com/threaded-locating-pin-accessory.*

(Continued)

*Primary Examiner* — Alexander B Comley
(74) *Attorney, Agent, or Firm* — Finnegan, Henderson, Farabow, Garrett & Dunner, LLP.

(57) ABSTRACT

A pump is disclosed. The pump may have a housing connectable to a transmission of a machine adjacent a front end of the pump. The pump may also have a flange attached to the housing adjacent a rear end of the pump. The flange may have a longitudinal axis extending along a length of the flange, and a transverse axis extending along a width of the flange. The flange may also have a first mounting hole configured to connect an auxiliary pump to the flange. Further, the flange may have a second mounting hole configured to connect a bracket to the flange. The first mounting hole may be positioned on a first axis inclined at an acute angle relative to the longitudinal axis of the flange.

15 Claims, 4 Drawing Sheets

(56) References Cited

U.S. PATENT DOCUMENTS

| | | | | |
|---|---|---|---|---|
| 7,681,487 | B2 * | 3/2010 | Galba | F04B 23/06 91/499 |
| 7,946,810 | B2 * | 5/2011 | Towsley | F04D 29/4293 415/206 |
| 8,807,972 | B2 * | 8/2014 | Reighard | F01C 21/007 418/166 |
| 9,074,670 | B1 | 7/2015 | Bonny | |
| 9,890,783 | B2 * | 2/2018 | Wilkinson | F01C 21/10 |
| 10,677,244 | B2 * | 6/2020 | Byrne | F16C 35/067 |
| 2006/0257267 | A1 | 11/2006 | Weiss | |
| 2010/0003144 | A1 * | 1/2010 | Shimazaki | F04B 41/06 417/269 |
| 2016/0131118 | A1 * | 5/2016 | Weathersbee | F04B 1/24 92/13 |
| 2018/0335025 | A1 * | 11/2018 | Wilson | E04G 21/04 |
| 2020/0325761 | A1 * | 10/2020 | Williams | F04B 15/02 |

FOREIGN PATENT DOCUMENTS

| | | |
|---|---|---|
| EP | 0999365 | 5/2004 |
| EP | 3153705 A1 * | 4/2017 |
| EP | 3904687 | 11/2021 |
| JP | 3209860 B2 * | 9/2001 |

OTHER PUBLICATIONS

U.S. Design Patent Application, titled "Flange" of Romas J. Povilonis et al., filed May 4, 2022.

Written Opinion and International Search Report for Int'l. Patent Appln. No. PCT/US2023/020151, mailed Jul. 12, 2023 (19 pgs).

* cited by examiner

PUMP HAVING A FLANGE FOR MOUNTING AN AUXILIARY PUMP

TECHNICAL FIELD

The present disclosure relates generally to a pump, and more particularly, to a pump having a flange for mounting an auxiliary pump.

BACKGROUND

An industrial machine, for example, wheel loader, excavator, shovel, continuous miner, loader, or truck, includes an engine that provides power for propelling the machine and for operation of one or more work tools of the machine. Operation of the engine and/or the machine may require a variety of fluids. For example, the engine requires fuel for combustion. The engine also requires engine lubricant for lubrication of its moving parts, and coolant to cool various engine components. Likewise the machine may require transmission fluid to lubricate components of a transmission connecting the engine with wheels or tracked undercarriages of the machine, brake fluid to activate brakes on the wheels, and/or hydraulic fluid for the operation of one or more work implements.

The fluids required for operation of the machine may be supplied by one or more pumps that may be driven by the engine. In some configurations, at least some of the pumps of the machine may be assembled in the form of a pump stack with the pumps attached to each other back-to-back in a tandem configuration. In such a configuration, the first pump in the pump stack may be connected to and driven via a transmission or gear box associated with the engine, while the other pumps in the pumps stack may be driven by the shaft of the first pump. In some configurations, it may be necessary to add an additional pump to the pump stack to supply additional fluid to an existing component of the machine or to supply fluid to a new component being added to the machine. For example, an additional working implement may be added to the machine for performing operations at a worksite. Addition of one or more pumps to the pump stack may increase a weight of the pump stack and may require additional structural elements for mounting the pump to the chassis or to the transmission of the machine. Addition of one or more pumps to the pump stack may also require modifications to or replacement of one or more pumps already present in the pump stack.

U.S. Pat. No. 8,807,972 B2 of Reighard et al. issued on Aug. 19, 2014 ("the '972 patent") and discloses a pump assembly for connecting a plurality of pumps in stack relation to one another. The '972 patent discloses a pump stack having three pumps connected to each other back-two-back in a tandem configuration. The pump stack of the '972 patent includes a first pump connectable to a gear configured to drive the pumps. Further, the pump stack includes retaining rods for connecting a second pump to a rear of the first pump, and for connecting a third pump to a rear of the second pump. In particular, the '972 patent discloses a first retaining rod that extends through the first and second pumps, and a second retaining rod that extends through the second and the third pump. The retaining rods are spring-loaded on one end and include a retaining clip to connect an opposite end of the rod to a respective pump housing.

Although the '972 patent discloses an assembly for attaching pumps to each other in a back-two-back tandem configuration, the pump stack assembly of the '972 patent may be sub-optimal. For example, addition of a pump to the pump stack of the '972 patent may require machining the new pump to allow for assembly of retaining rods. Moreover, the existing pumps in the pump stack may have to be replaced or machined with additional holes to accommodate retaining rods for assembly of the new pump. Furthermore, the use of springs and retaining clips for assembly of the pumps may allow relative lateral movement of adjacent pumps in the pump stack of the '972 patent due to vibrations of the machine. Such relative movement may exert additional forces on the bearings of the shafts driving the pumps, potentially decreasing the reliability of the bearings and the pumps. Moreover, the retaining rods of the '972 patent are not attached to the gearbox and do not support the weight of the pumps in the pump stack. Thus, the entire weight of the pump stack is supported by the fasteners connecting the first pump in the stack to the gearbox. Such a configuration may induce additional stresses on the gearbox and/or the first pump due to the weight of the pumps in the pump stack, which in turn may decrease the reliability of the bearings and pumps in the pump stack.

The pump and flange of the present disclosure solve one or more of the problems set forth above and/or other problems of the prior art.

SUMMARY

In one aspect, the present disclosure is directed to a pump. The pump may include a housing connectable to a transmission of a machine adjacent a front end of the pump. The pump may also include a flange attached to the housing adjacent a rear end of the pump. The flange may include a longitudinal axis extending along a length of the flange, and a transverse axis extending along a width of the flange. The flange may also include a first mounting hole configured to connect an auxiliary pump to the flange. Further, the flange may include a second mounting hole configured to connect a bracket to the flange. The first mounting hole may be positioned on a first axis inclined at an acute angle relative to the longitudinal axis of the flange.

In another aspect, the present disclosure is directed to a pump stack for a machine. The pump stack may include a first pump mounted at a front end to a gearbox of the machine. The pump stack may also include a second pump mounted to a rear end of the first pump. A housing of the second pump may include a flange. The flange may include a longitudinal axis extending along a length of the flange, and a transverse axis extending along a width of the flange. The flange may also include a first pair of mounting holes configured to connect an auxiliary pump to the housing. In addition, the flange may include a second pair of mounting holes configured to connect a bracket to the housing. The first pair of mounting holes may be positioned on a first axis inclined at an acute angle relative to the longitudinal axis of the flange.

In yet another aspect the present disclosure is directed to a machine. The machine may include a chassis supported by a plurality of wheels and at least one working implement connectable to the chassis. The machine may also include an engine and a gearbox driven by the engine. The gearbox may be connectable to the engine and the wheels. The machine may include a pump stack driven by the engine. The pump stack may be configured to supply hydraulic fluid to the at least one working implement. The pump stack may include a first pump having a front end mounted to the gearbox. The pump stack may also include a second pump mounted to a rear end of the first pump. A housing of the second pump may include a flange. The flange may include a longitudinal axis extending along a length of the flange, and a transverse axis extending along a width of the flange. The flange may also include a first pair of mounting holes configured to connect an auxiliary pump to the housing and a second pair of mounting holes. The first pair of mounting holes may be positioned on a first axis inclined at an acute angle relative to the longitudinal axis of the flange. The pump stack may include a pump shaft configured to be driven by the engine. The pump shaft may include a splined recess configured to engage with a shaft of the auxiliary pump. The machine may also include a bracket having one end connected to the pump stack via fasteners passing through the second pair of mounting holes. An opposite end of the bracket may be connected to at least one of the gearbox or the chassis of the machine.

DETAILED DESCRIPTION

Figure 1:
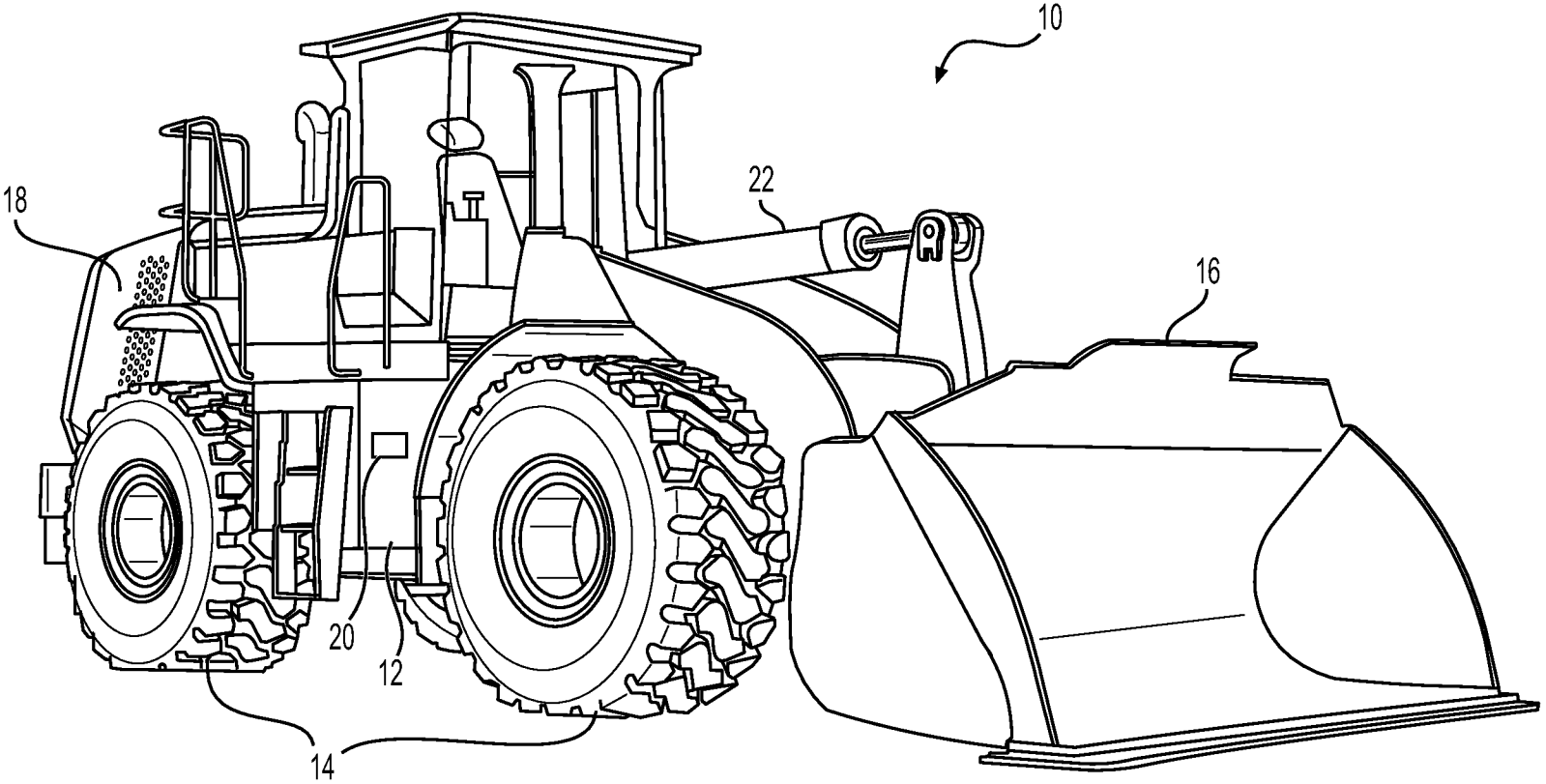
FIG. 1 is a pictorial illustration of an exemplary disclosed machine

FIG. 1 illustrates an exemplary mobile machine 10. In the depicted embodiment, the machine 10 is a wheel loader. It is contemplated, however, that machine 10 may embody another type of mobile machine such as an excavator, a shovel, a continuous miner, a loader, a truck, a track-type-tractor, a motor grader, an articulated haul truck, an off-highway mining truck, or another construction machine known in the art. Machine 10 may include chassis 12, one or more traction devices 14 that support chassis 12 on a ground surface, at least one working implement 16, and engine 18. In one exemplary embodiment as illustrated in FIG. 1, traction devices 14 may take the form of wheels 14, although other types of traction devices such as crawler tracks are also contemplated.

Engine 18 may be any suitable type of internal combustion engine, such as a gasoline, diesel, natural gas, or hybrid-powered engine. It is contemplated, however, that in some exemplary embodiments, engine 18 may be driven by electrical power. Engine 18 may be configured to propel the one or more traction devices 14 via transmission 20. Engine 18 may also be configured to deliver power to operate one or more other components or accessory devices (e.g. pumps, fans, motors, generators, belt drives) associated with machine 10. For example, engine 18 may be configured to drive one or more pumps that may be configured to deliver hydraulic fluid to hydraulic actuator 22, which may be configured to move working implement 16.

Figure 2:
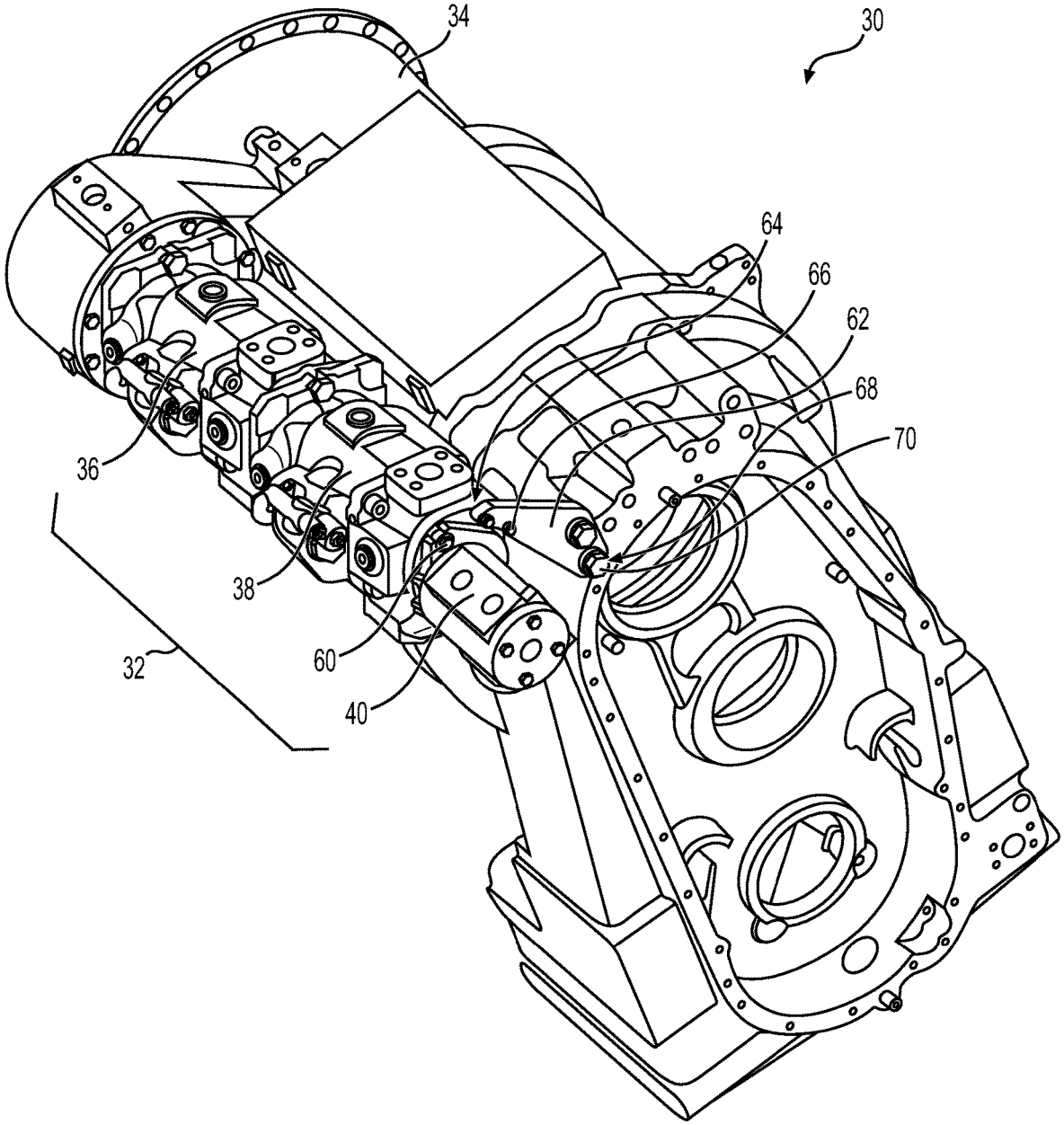
FIG. 2 is an illustration of an exemplary disclosed pump stack assembly for the machine of FIG. 1.

FIG. 2 illustrates an exemplary pump stack assembly 30. Pump stack assembly 30 may include pump stack 32 attached to a portion of transmission 20 of machine 10. In one exemplary embodiment as illustrated in FIG. 2, pump stack 32 may be attached to gearbox 34 that may be included in transmission 20. Gearbox 34 and/or transmission 20 may in turn be attached to chassis 12 of machine 10. Pump stack 32 may include one or more pumps that may be configured to pump fluids such as fuel, lubricant, coolant, and/or hydraulic fluid to various components of machine 10. In one exemplary embodiment as illustrated in FIG. 2, pump stack 32 may include pumps 36, 38, and 40. Although only three pumps 36, 38, and 40 are illustrated as making up pump stack 32, it is contemplated that pump stack 32 may include more than or less than three pumps 36, 38, and 40. Further, pumps 36, 38, and 40 may include a same type of pump (e.g., vane pump, piston pump, gear pump). Alternatively, some or all of pumps 36, 38, and/or 40 may be of different types from each other. Similarly, pumps 36, 38, and 40 may be configured to pump the same kind of fluid (e.g., hydraulic fluid) or may be configured to pump different kinds of fluids (e.g., fuel, coolant, lubricant).

First pump 36 may be attached to gearbox 34 and may include pump shaft 50 (see FIG. 3) that may engage with one or more gears within gearbox 34. Second pump 38 may be attached to a rear end of first pump 36 and may include pump shaft 98 (see FIG. 4) that may engage with pump shaft 50. Third pump 40 may be connected to rear end 48 of second pump 38 via one or more fasteners. Third pump 40 may also include a shaft that may engage with pump shaft 98 (see FIG. 4) of second pump 38. Thus, engine 18 may be configured to drive first pump 36, second pump 38, and/or third pump 40 by causing the rotation of pump shaft 50 via gearbox 34. It is contemplated, that some exemplary embodiments of machine 10 may include only first pump 36 and second pump 38. Other exemplary embodiments of machine 10 may include third pump 40, which may be an auxiliary pump that may be added to pump stack 32 to provide additional fluid to one or more existing components of machine 10. Alternatively, auxiliary pump 40 may be added to pump stack 32 to provide fluid to a new component or working implemented being added to machine 10.

Figure 3:
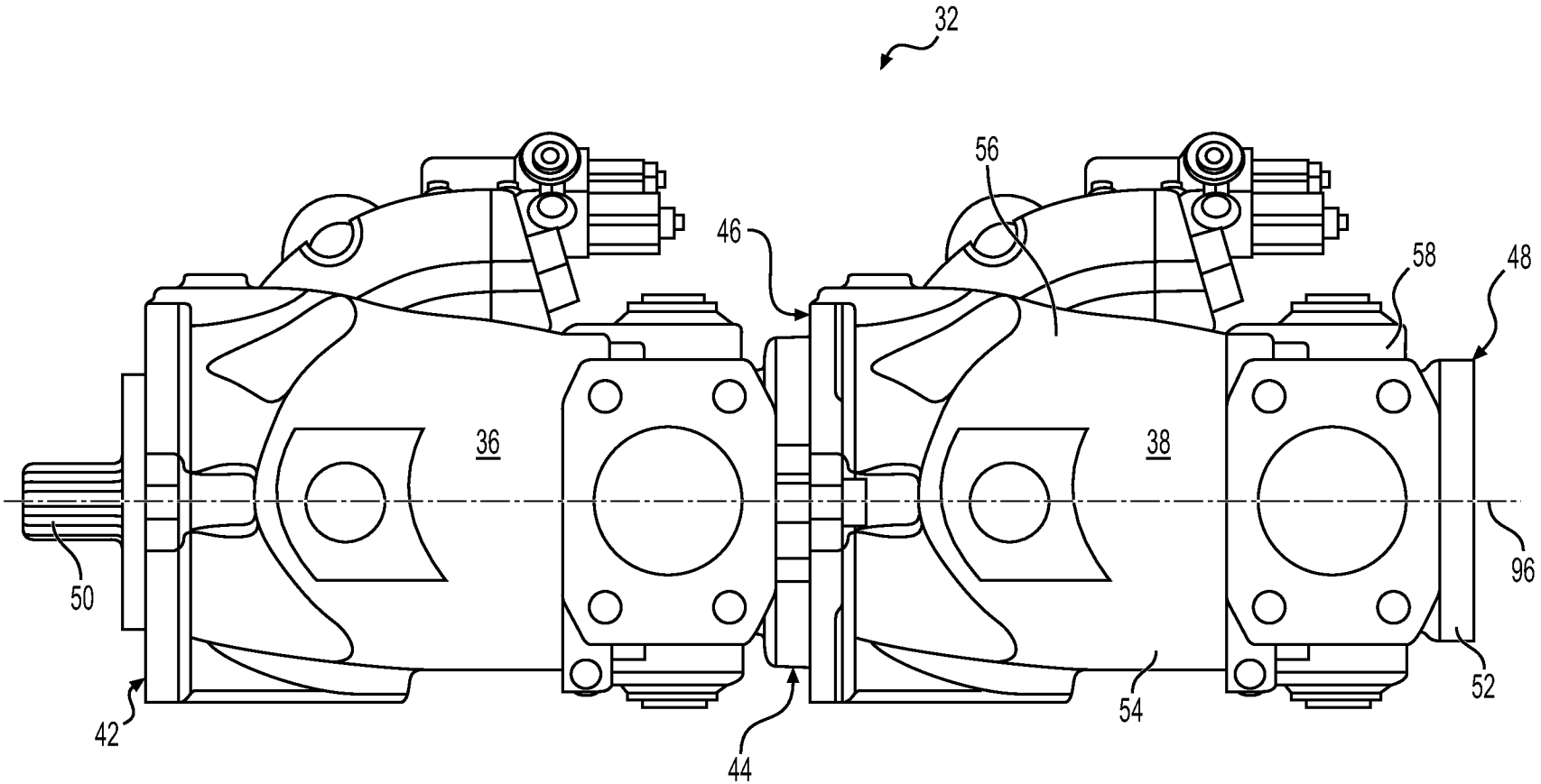
FIG. 3 is a side view of the exemplary disclosed pump stack assembly of FIG. 2, showing a pump stack having a pair of pumps.

FIG. 3 illustrates a side view of pump stack 32, including pumps 36 and 38. As illustrated in FIG. 3, first pump 36 may extend from front end 42 of pump 36 to rear end 44 of pump 36. First pump 36 may be connected to gearbox 34 adjacent front end 42. First pump 36 may include pump shaft 50 that may be configured to engage with one or more gears of gearbox 34 and may be driven by engine 18 via gearbox 34. Second pump 38 may extend from front end 46 of pump 38 to rear end 48 of pump 38. Front end 46 of pump 38 may be connected to rear end 44 of first pump 36 via one or more fasteners. Second pump 38 may include pump shaft 98 (see FIG. 4) that may engage with pump shaft 50 of first pump 36. Thus, rotation of pump shaft 50 by engine 18 may also drive second pump 38 by rotating pump shaft 98.

As also illustrated in FIG. 3, second pump 38 may include housing 54. In one exemplary embodiment as illustrated in FIG. 3, housing 54 may be a two-part housing, including front housing 56 and rear housing 58. Front housing 56 may be connected to rear end 44 of pump 36. Rear housing 58 may be connected to front housing 56. Rear housing 58 of pump 38 may include flange 52. Although second pump 38 has been illustrated in FIG. 3 as having a two-part housing, it is contemplated that in some exemplary embodiments, pump 38 may have a single housing 54. In some exemplary embodiments, flange 52 may be integral with housing 54 in the form of a single casting. It is contemplated, however, that in other exemplary embodiments, flange 52 may be a separate piece that may be removably attached to housing 54 (or rear housing 58) via fasteners. Alternatively, in some exemplary embodiments, flange 52 may be fixedly attached to housing 54 (or rear housing 58) by welding, brazing, or other attachment methods.

Returning to FIG. 2, third pump 40 (or auxiliary pump 40) may be attached to flange 52 of rear end 48 of second pump 38 via fasteners 60. As also illustrated in FIG. 2, in some exemplary embodiments, pump stack assembly 30 may include bracket 62. One end 64 of bracket 62 may be attached to flange 52 via fasteners 66. Opposite end 68 of bracket 62 may be attached to gearbox 34, another portion of transmission 20, and/or to chassis 12 via fasteners 70. Thus, a weight of pump stack 32 may be supported by gearbox 34 adjacent front end 42 of pump 36 and by bracket 62 adjacent rear end 48 of pump 38. It is contemplated, however, that some exemplary embodiments of pump stack assembly 30 may not include bracket 62.

Figure 4:
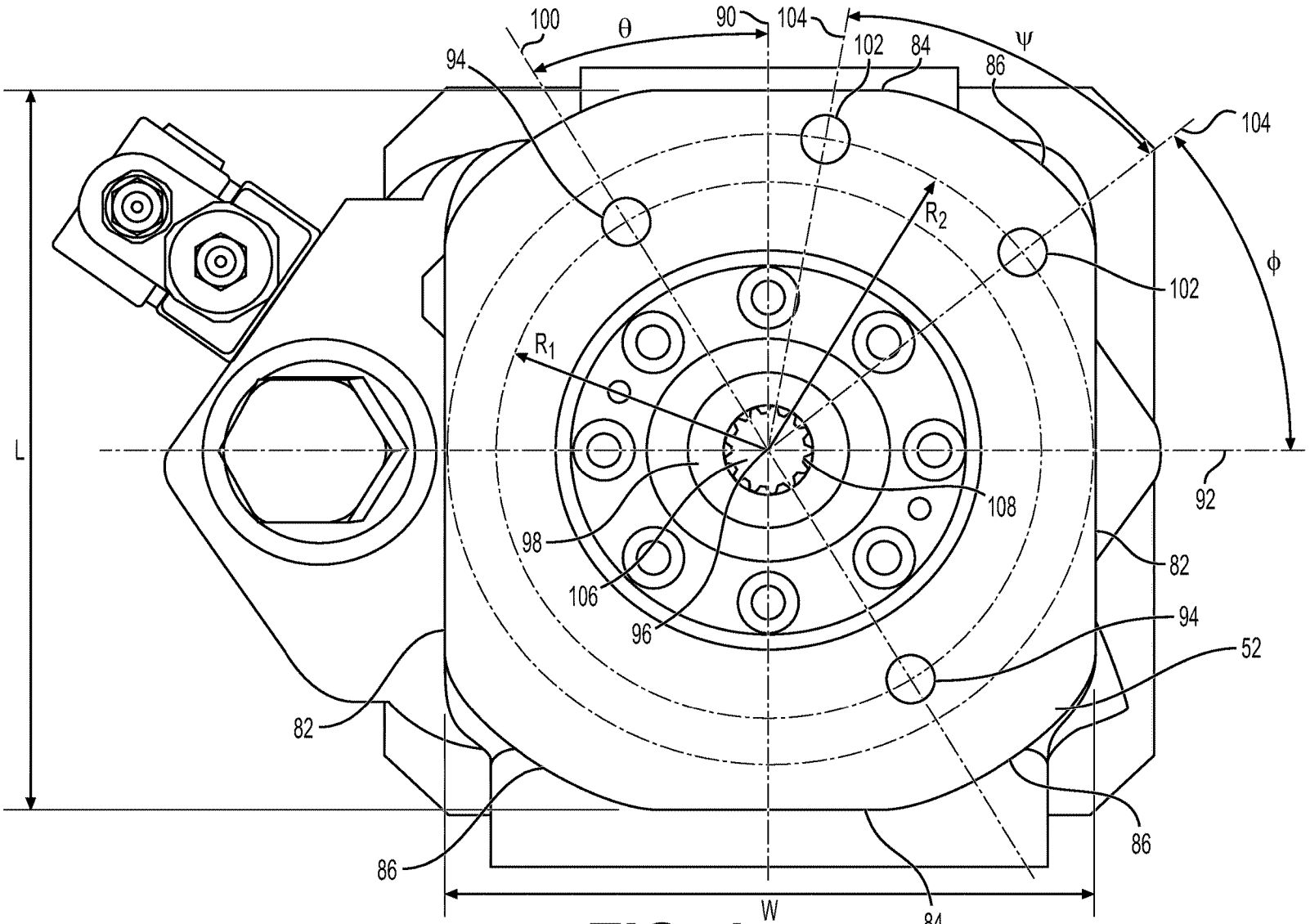
FIG. 4 is an elevation view of an exemplary disclosed flange of a pump included in the pump stack of FIG. 3.

FIG. 4 illustrates an elevation view of an exemplary disclosed flange 52 of pump 38 included in pump stack 32. Flange 52 may be an elongated plate-like structure having two generally linear vertical edges 82 spaced apart from each other, and two generally linear horizontal edges 84 spaced apart from each other. Curvilinear edges 86 may connect vertical edge 82 with an adjacently located horizontal edge 84. It is contemplated, however, that flange 52 may have other shapes, for example, rectangular, square, circular, oval, etc. In one exemplary embodiment as illustrated in FIG. 4, flange 52 may have a length "L" that may be larger than a width "W." It is contemplated, however, that in other exemplary embodiments, length L of flange 52 may be equal to or smaller than width W of flange 52. As further illustrated in FIG. 4, flange 52 may include longitudinal axis 90 extending along a length of flange 52. Longitudinal axis 90 may be disposed generally parallel to vertical edges 82 of flange 52. In one exemplary embodiment as illustrated in FIG. 4, vertical edges 82 may be symmetrically positioned on opposite sides of longitudinal axis 90. Flange 52 may also include transverse axis 92 extending along a width of flange 52. Transverse axis 92 may be disposed generally parallel to a horizontal edges 84 of flange 52. In one exemplary embodiment as illustrated in FIG. 4, horizontal edges 84 may be symmetrically positioned on opposite sides of transverse axis 99. Longitudinal axis 90 may be disposed generally perpendicular to transverse axis 92 of flange 52. The term generally as used in this disclosure encompasses typical machining and manufacturing tolerances. Thus, for example, generally perpendicular may encompass angles in the range 90°±1°, and generally parallel may encompass angles in the range of 0°±1°.

Flange 52 may include one or more mounting holes 94 configured to receive one or more fasteners 60 for attaching auxiliary pump 40 to flange 52. In one exemplary embodiment as illustrated in FIG. 4, flange 52 may include a pair of mounting holes 94 positioned diametrically opposite from each other. Mounting holes 94 may be positioned at a radius "$R_1$" relative to axis of rotation 96 (see FIG. 3) of pump shaft 98 of pump 38. In one exemplary embodiment, mounting holes 94 may be positioned on opposite sides of longitudinal axis 90, for example, on an axis 100 that may be inclined at an acute angle θ relative to longitudinal axis 90 of flange 52. In one exemplary embodiment, axis 100 may pass through centers of mounting holes 94. Flange 52 may also include one or more mounting holes 102 configured to receive one or more fasteners for attaching bracket 62 to flange 52. Mounting holes 102 may be disposed at a radius "$R_2$" relative to axis of rotation 96 of pump shaft 98 of pump 38. In one exemplary embodiment as illustrated in FIG. 4, radius $R_1$ may be smaller than radius $R_2$. It is contemplated, however, that in other exemplary embodiments, radius $R_1$ may be larger than or equal to radius $R_2$. As also illustrated in the exemplary embodiment of FIG. 4, the pair of mounting holes 102 may be positioned on a pair of axes 104 inclined at an acute angle ψ relative to each other. In one exemplary embodiment, each axis 104 may pass through a center of an associated mounting hole 102. In some exemplary embodiments as illustrated in FIG. 4, the pair of mounting holes 104 may be positioned on one side of longitudinal axis 90 and/or on one side of axis 100 passing through mounting holes 94. As further illustrated in FIG. 4, at least one mounting hole 102 may be positioned on an axis inclined at an acute angle ϕ relative to transverse axis 92. In one exemplary embodiment as illustrated in FIG. 4, at least one mounting hole 94 and at least one mounting hole 102 may be positioned on opposite sides of longitudinal axis 90. In one exemplary embodiment, some or all of mounting holes 94 and/or 104 may be through holes. It is contemplated, however, that in other exemplary embodiments, some or all of mounting holes 94 and 104 may be threaded. Although particular locations of mounting holes 94 and 104 have been discussed above, it is contemplated that mounting holes 94 and 104 may be disposed at other positions on flange 52.

Pump shaft 98 of pump 38 may engage with pump shaft 50 of pump 36 adjacent rear end 44 of pump 38. Pump shaft 98 of pump 38 may include a generally cylindrical recess 106 extending into pump shaft 98 from adjacent rear end 48 of pump 38 towards front end 46 of pump 38. In one exemplary embodiment as illustrated in FIG. 4, a wall of recess 106 may include a plurality of splines 108. A shaft of auxiliary pump 40 may be configured to engage with splines 108 when auxiliary pump 40 is attached to flange 52. Thus, pump shaft 50 of pump 36 may drive pump shaft 98 of pump 38, which in turn may drive the shaft of auxiliary pump 40.

INDUSTRIAL APPLICABILITY

The disclosed pump 38 with flange 52 may provide several advantages. For example, the arrangement and positions of mounting holes 94 on flange 52 may help ensure ease of assembly of an auxiliary pump 40 to pump 38, particularly on an existing pump stack 32 during maintenance or repair of machine 10. In some exemplary embodiments, an auxiliary pump 40 may be added to supply fluid when replacing an existing component on machine 10 with a component of larger size or when adding a new component to machine 10. For example, an additional auxiliary pump 40 may be required to provide hydraulic fluid to a working implement added to machine 10 during maintenance or at a construction site. Positioning mounting holes 94 on axis 100 that is inclined relative to longitudinal axis 90 may allow for attachment of auxiliary pump 40 to pump 38 without the need for replacement, resizing, or machining of pump 38 and/or a need for changing a size of flange 52. Further, use of removable fasteners 60 to attach auxiliary pump 40 may allow pump 38 and/or pump 40 to be easily connected to or disconnected from each other, for example, for maintenance and/or repair. The use of fasteners 60 in mounting holes 94 may also allow pump 38 to be tightly fastened to pump 40 to help decrease the likelihood of lateral movement of pump 40 relative to pump 38, minimizing the amount of radial forces that may be exerted on bearings supporting pump shaft 98 and/or a shaft of auxiliary pump 40.

Additionally, mounting holes 102 on flange 52 may allow for attachment of bracket 62 to flange 52. One end 64 of bracket 62 may be attached to flange 52 fasteners 66. An opposite end 68 of bracket 62 may be attached to gearbox 34, transmission 20 and/or chassis 12 via fasteners 70. Thus, a weight of pump stack 32 may be supported by gearbox 34 adjacent front end 42 of pump 36 and by gearbox 34, transmission 20 and/or chassis 12 adjacent rear end 48 of pump 38 via bracket 62. Supporting pump stack 32 on both ends in this manner may minimize the effect of the weight of pump stack 32 on radial forces exerted on the fasteners attaching pump stack 32 machine 10 and/or on the bearings supporting pump shafts 50 and 98. This in turn may help increase the reliability of pumps 36, 38, and 40 and of pump stack assembly 30. Thus, the disclosed flange 52 and its arrangement of mounting holes 94 and 102 may help ensure ease of assembly/disassembly of auxiliary pump 40 to/from pump stack 32, and may also minimize the risk of damage to shaft 50, pump shaft 98, and/or bearings supporting shaft 50 and/or pump shaft 98 due to a weight of pumps 36, 38, and 40.

It will be apparent to those skilled in the art that various modifications and variations can be made to the disclosed pump and flange. Other embodiments will be apparent to those skilled in the art from consideration of the specification and practice of the disclosed pump and flange. It is intended that the specification and examples be considered as exemplary only, with a true scope being indicated by the following claims and their equivalents.

What is claimed is:

1. A pump stack for a machine, comprising:

a first pump mounted at a front end to a gearbox of the machine, the first pump including a first pump shaft;

a second pump mounted to a rear end of the first pump, the second pump including a housing, a flange protruding from the housing, and a second pump shaft configured to engage with the first pump shaft, the flange comprising:

a longitudinal axis extending along a length of the flange;

a transverse axis extending along a width of the flange;

a first pair of mounting holes configured to connect an auxiliary pump to the housing, wherein the first pair of mounting holes are located at a first radial distance relative to the second pump shaft, and the first pair of mounting holes are positioned on a first axis inclined at a first acute angle relative to the longitudinal axis of the flange; and a second pair of mounting holes configured to connect a bracket to the housing, the second pair of mounting holes being located at a second radial distance relative to the second pump shaft, the second radial distance being greater than the first radial distance, wherein the bracket extends across a gap between the flange and one of the gearbox or a chassis of the machine, and the bracket further includes:

a first end that is attached to the flange, and a second end that is attached to one of the gearbox or the chassis of the machine.

2. The pump stack of claim 1, wherein the second pair of mounting holes are positioned on respective axes inclined at a second acute angle relative to each other.

3. The pump stack of claim 2, wherein the respective axes are each inclined at respective third acute angles relative to the longitudinal axis of the flange.

4. The pump stack of claim 1, wherein the second pair of mounting holes are positioned on one side of the first axis.

5. The pump stack of claim 1, wherein the first pair of mounting holes are positioned on opposite sides of the longitudinal axis.

6. The pump stack of claim 1, wherein at least one mounting hole of the first pair of mounting holes and the second pair of mounting holes is threaded.

7. The pump stack of claim 1, wherein the second pump shaft includes a splined recess configured to receive a shaft of the auxiliary pump.

8. The pump stack of claim 1, wherein the bracket is attached to the housing of the second pump via the second pair of mounting holes, the bracket also being attached to one of the gearbox or a chassis of the machine.

9. The pump stack of claim 1, wherein the bracket includes an elongated structural member extending from the first end to the second end.

10. The pump stack of claim 1, wherein the first end of the bracket is attached to at least one mounting hole of the second pair of mounting holes of the flange via a fastener, and the second end of the bracket is attached to the gearbox or the chassis via another fastener.

11. The pump stack of claim 10, wherein the first end of the bracket is attached to the second pair of mounting holes of the flange via a pair of fasteners.

12. The pump stack of claim 10, wherein the second end of the bracket is attached to the gearbox or the chassis via a pair of fasteners.

13. The pump stack of claim 1, wherein the flange includes a first flange surface connected to the housing of the second pump and a second flange surface disposed opposite to and separated from the first flange surface by a thickness of the flange.

14. The pump stack of claim 1, wherein the flange is integral with the housing of the second pump.

15. The pump stack of claim 1, wherein the flange is removably attachable to the housing of the second pump.

* * * * *